US007978080B2

(12) United States Patent
Bleckmann et al.

(10) Patent No.: US 7,978,080 B2
(45) **Date of Patent: *Jul. 12, 2011**

(54) PLIABLE MATERIAL LOOP TAG

(76) Inventors: Frederick A. Bleckmann, Barrington, NH (US); James Brodzik, Somerdale, NJ (US); Bryan T. R. Rowland, Blackwood, NJ (US)

( * ) Notice: Subject to any disclaimer, the term of this patent is extended or adjusted under 35 U.S.C. 154(b) by 263 days.

This patent is subject to a terminal disclaimer.

(21) Appl. No.: 12/264,640

(22) Filed: Nov. 4, 2008

(65) Prior Publication Data

US 2009/0115615 A1 May 7, 2009

Related U.S. Application Data

(60) Provisional application No. 60/985,695, filed on Nov. 6, 2007.

(51) Int. Cl.
*G08B 13/14* (2006.01)

(52) U.S. Cl. ..... 340/572.8; 340/572.1; 340/568.1; 340/571

(58) Field of Classification Search ..... 340/572.8, 340/572.1, 568.1, 571
See application file for complete search history.

(56) References Cited

U.S. PATENT DOCUMENTS

| | | | | |
|---|---|---|---|---|
| 3,270,453 | A | 9/1966 | Mitchell | |
| 3,777,378 | A | 12/1973 | Sant'Anselmo | |
| 5,508,684 | A | 4/1996 | Becker | |
| 5,583,489 | A | 12/1996 | Loemker et al. | |
| 5,945,909 | A | 8/1999 | Kolton | |
| 6,052,876 | A | 4/2000 | Hogan et al. | |
| 6,188,320 | B1 | 2/2001 | Kolton et al. | |
| 6,254,953 | B1 * | 7/2001 | Elston | 428/40.1 |
| 6,367,426 | B1 | 4/2002 | Schaible | |
| 6,432,235 | B1 | 8/2002 | Bleckmann et al. | |
| 6,433,686 | B1 | 8/2002 | Feibelman | |
| 6,550,813 | B1 | 4/2003 | Siegrist | |
| 6,671,987 | B1 | 1/2004 | Fenton | |
| 6,724,311 | B1 * | 4/2004 | Kolton et al. | 340/572.8 |
| 6,780,265 | B2 | 8/2004 | Bleckmann et al. | |
| 6,827,817 | B2 | 12/2004 | Bleckmann et al. | |
| 6,836,215 | B1 * | 12/2004 | Laurash et al. | 340/572.1 |
| 2002/0154014 | A1 | 10/2002 | Elston | |

(Continued)

FOREIGN PATENT DOCUMENTS

| | | |
|---|---|---|
| DE | 20316078 | 2/2004 |

(Continued)

OTHER PUBLICATIONS

International Search Report for corresponding PCT Application No. PCT/US2008/082457, dated Feb. 4, 2009.

(Continued)

*Primary Examiner* — Toan N Pham
(74) *Attorney, Agent, or Firm* — Caesar, Rivise, Bernstein, Cohen & Pokotilow, Ltd.

(57) ABSTRACT

A security tag that can be attached to an item or items that provides a zero or low impact to the item or items such as elegant or soft goods. The security tag includes a security element that is enclosed within a pliable material that is looped around the item or items it is protecting and then is closed on itself or on an extension of the pliable material. No puncturing, piercing or adhesive attachment to the elegant or soft goods occurs, thereby making a "zero or low impact" on the item while also making a pleasant presentation to customers when the item (or items) is displayed.

17 Claims, 13 Drawing Sheets

U.S. PATENT DOCUMENTS

| | | | | |
|---|---|---|---|---|
| 2005/0000134 | A1 | 1/2005 | Davis et al. | |
| 2006/0255952 | A1 | 11/2006 | Waegner | |
| 2008/0303637 | A1* | 12/2008 | Gelbman et al. | 340/10.42 |

FOREIGN PATENT DOCUMENTS

| | | |
|---|---|---|
| EP | 0595549 | 5/1994 |
| EP | 0692774 | 1/1996 |
| EP | 1054369 | 11/2000 |
| EP | 1388827 | 2/2004 |
| EP | 1171300 | 11/2005 |
| EP | 1390926 | 4/2007 |
| FR | 2804303 | 8/2001 |
| GB | 201691 | 8/1923 |
| GB | 198989 | 5/1924 |
| WO | 98/24075 | 6/1998 |
| WO | 2005/043494 | 5/2005 |

OTHER PUBLICATIONS

International Search Report for corresponding PCT Application No. PCT/US2008/085553 dated Sep. 15, 2009.

* cited by examiner

FIG.5
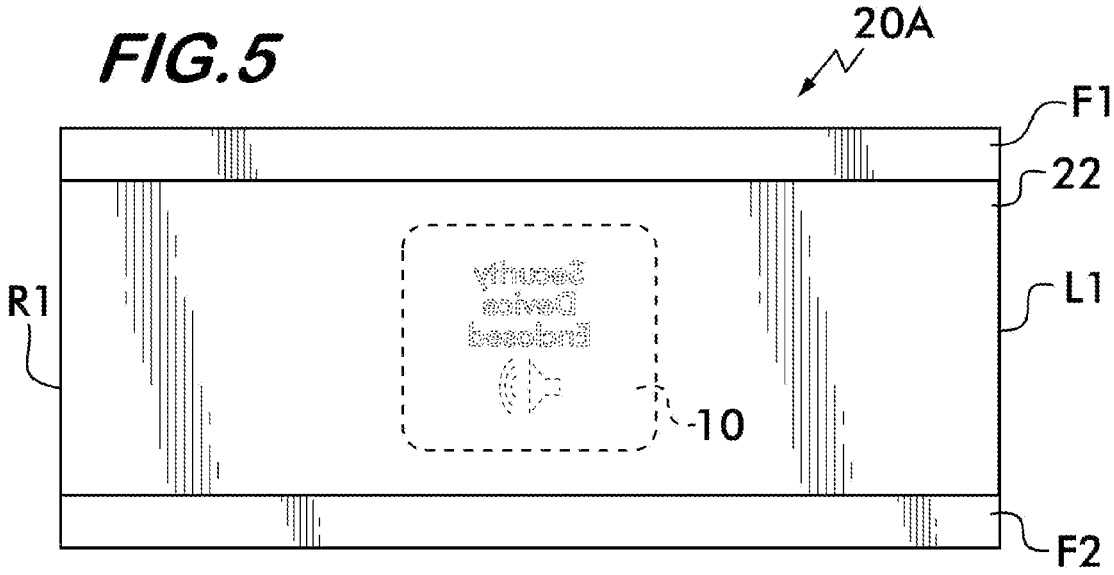
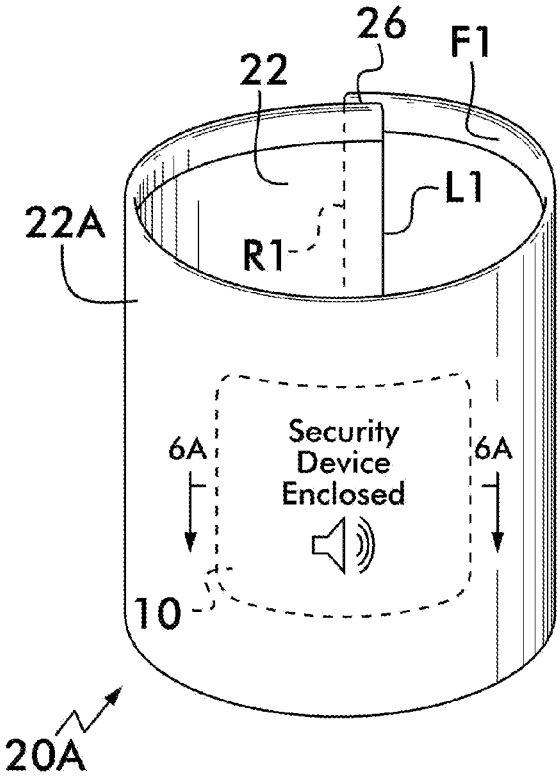
FIG.6

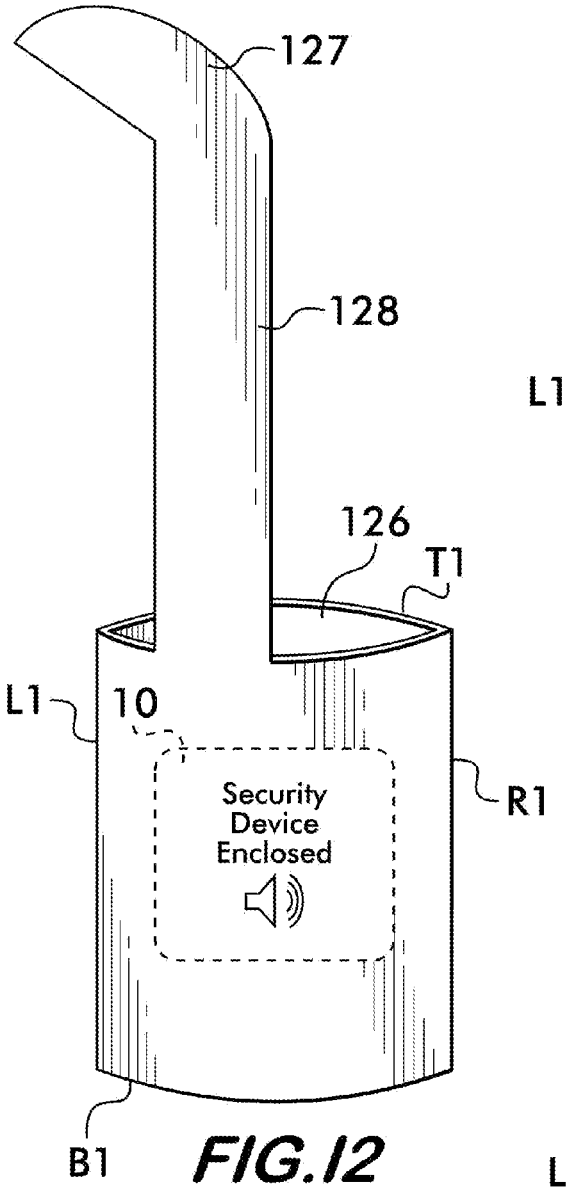
FIG.12
FIG.13
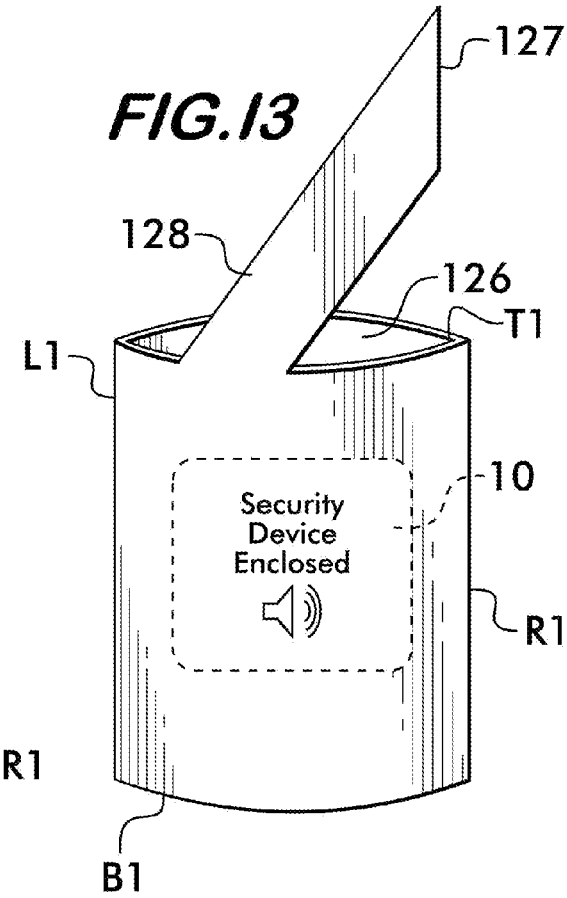
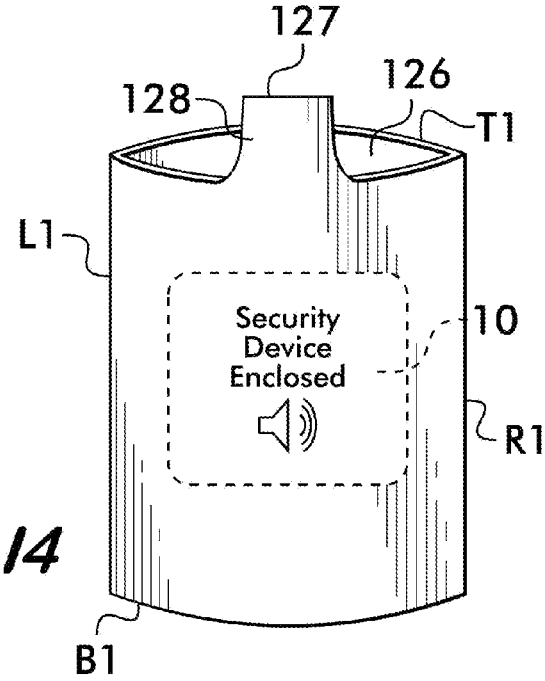
FIG.14

FIG.18
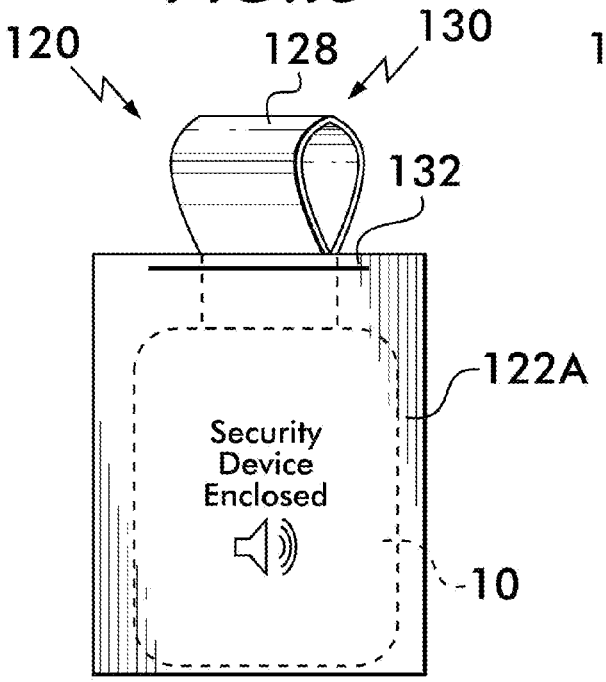
FIG.19
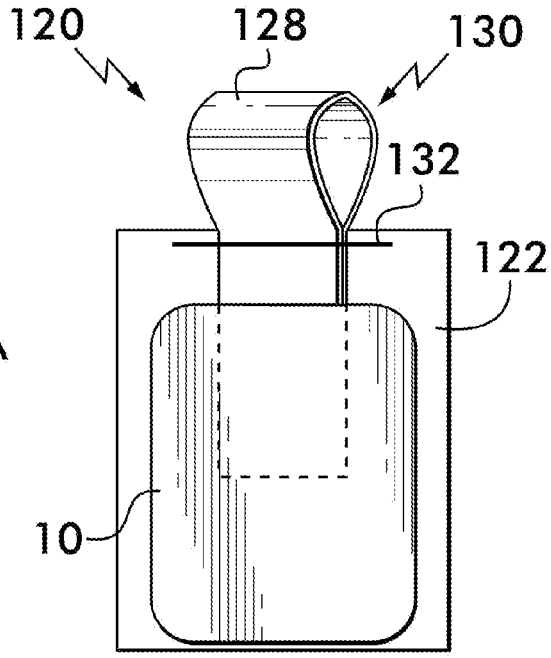
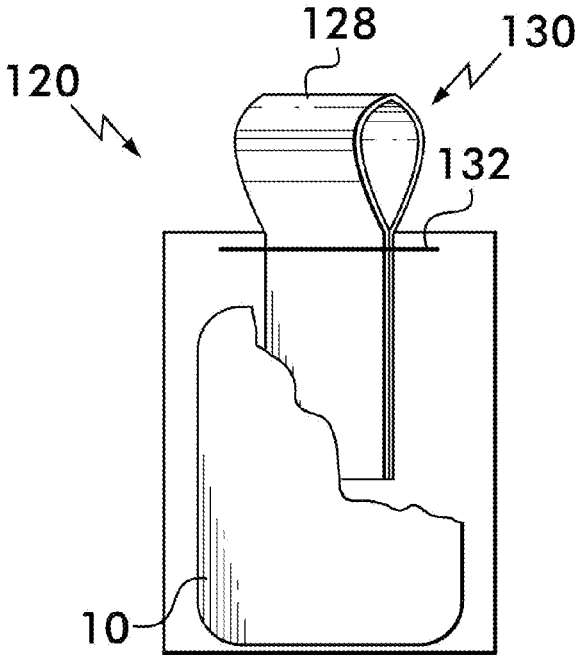
FIG.20

PLIABLE MATERIAL LOOP TAG

CROSS-REFERENCE TO RELATED APPLICATIONS

This application claims the benefit under 35 U.S.C. §119 (e) of Provisional Application Ser. No. 60/985,695 filed on Nov. 6, 2007, entitled PLIABLE MATERIAL LOOP TAG and whose entire disclosure is incorporated by reference herein.

BACKGROUND OF THE INVENTION

1. Field of Invention

The present invention relates to security tags and more particularly, discloses a pliable material loop tag for attachment to elegant or soft goods.

2. Description of Related Art

Many apparel items can be tagged (i.e., a security device or element applied) at the source using these existing product and methods. These security devices may comprise electronic article surveillance (EAS) elements, radio frequency identification (RFID) elements or combinations of such security devices, etc., and which can be wirelessly detected at business portals, e.g., store exits or points of sale (POS), etc. to prevent or diminish theft from the business. The actual tagging of the security device/element to the apparel "impacts" the apparel by either puncturing the apparel (e.g., pin and receptacle) or by being adhesively secured to the apparel, or being embedded (e.g., sewn) within the apparel. Not only does this create an undesirable effect (e.g., a puncture hole, a distortion, etc., in the apparel material) but it also disturbs the presentation of the apparel when displayed in the business. For example, the attachment of the security device/element to the apparel may distort or wrinkle the fabric when the apparel is positioned on the hanger, the mannequin, or other display methods. Another undesirable effect is that when the sewn tag or label is removed from the apparel, it leaves behind an undesirable remnant, further detracting from the elegance or presentation of the apparel. Such an uninviting display actually discourages patrons from even considering trying on the apparel, thereby losing a potential sale.

This is most apparent in many apparel items such as intimates, bathing suits and accessories but also occurs with soft goods. Soft goods include homeware items such as bedding, towels, fabrics, etc. Thus, these types of goods do not favor the known security devices and methods for attaching such devices due to the size of the goods or the invasive nature of the products known in the art. The attachment of a security device embedded in packaging for apparel, linens and soft goods is known in the art. A woven label such as that shown in U.S. Pat. No. 6,780,265 (Bleckmann, et al.) has an embedded EAS or RFID device. The method of attaching such a woven label by a sewing machine is also known in the art. Other methods are disclosed where the device is embedded within a paper ticket, price tag or hang tag (swing ticket). These products are also attached by known methods. By way of example, see U.S. Pat. Nos. 5,508,684 (Becker); 5,583,489 (Loemaker, et al.); 6,254,953 (Elston); and EP 1171300 (Bleckmann, et al.).

Moreover, where RFID security devices are used, many people have an apprehension with such devices when they are used in connection with personal items because it harbors connotations of invasion of privacy. RFID security devices typically include a memory regarding the item itself. Where such security devices are sewn into apparel, people are reluctant to purchase apparel that may permanently contain a device that may store information and which cannot be removed without damaging the apparel. Thus, the use of RFID security devices tend to increase the "impact" of such security devices on apparel.

U.S. Pat. No. 6,836,215 (Laurash, et al.) discloses a printable identification band of a flexible material such as paper or plastic that includes a cover patch which covers an RFID integrated circuit, that is either attached to the patch or to the band, and whereby opposite ends of the band are adhesively secured together around an object (e.g., a wrist, luggage handles, etc.). However, there is no teaching or suggestion of providing a pliable material in which is concealed a security tag, whereby the pliable material has upper and lower edges that are folded and whereby the pliable material has opposing ends, transverse to the upper and lower edges, that are fixedly secured together around a soft good.

Thus, in view of the foregoing, there remains a need for providing a security tag that can be secured to elegant items or soft goods without having to pierce, puncture or adhesively attach to such items and that minimize invasion of privacy concerns for customers, i.e., that provide a "zero or low impact" to such items.

All references cited herein are incorporated herein by reference in their entireties.

BRIEF SUMMARY OF THE INVENTION

The present invention provides a product and method for easily attaching a pliable non-invasive package embedded with at least one security element.

The present invention relates to a package into which the security element is embedded. The invention also relates to a tool for efficient and reliable attachment to an apparel item.

A security tag adapted for coupling to an item (e.g., elegant or soft goods) wherein the security tag comprises: at least one security element (e.g., an EAS or RFID security element or any combination thereof in any frequency range or ranges) that responds to a magnetic or electromagnetic field of a particular frequency or frequencies; and a pliable material (e.g., a woven fabric, plastic, other non-conductive pliable materials, etc.) in which the security element is positioned and wherein the pliable material comprises dimensions that are greater than dimensions of the security element, wherein the pliable material has upper and lower edges that are folded, and wherein the pliable material has closed opposing ends that can be looped around the item and over each other and wherein the opposing ends are fixedly secured (e.g., being sewn together, hot crimped, etc.) to each other.

A security tag that comprises a cover portion of a pliable material that overlays and sandwiches the security element between the cover portion and the pliable material to which the security element is attached.

A security tag wherein the pliable material comprises a rectangular shape having an axis that is parallel to its shorter side, and wherein the pliable material is looped about the axis.

A security tag wherein the pliable material comprises a rectangular shape having an axis that is parallel to its longer side, wherein the pliable material is looped about the axis.

A security tag wherein the pliable material is a woven fabric.

A security tag wherein the pliable material is plastic.

A security tag wherein the opposing ends are fixedly secured together using an adhesive.

A security tag wherein the opposing ends are fixedly secured together using ultrasonics.

A security tag wherein the opposing ends are fixedly secured together using rivets.

A security tag adapted for coupling to an item (e.g., elegant or soft goods) wherein the security tag comprises: at least one security element (e.g., an EAS or RFID security element or any combination thereof in any frequency range or ranges) that responds to a magnetic or electromagnetic field of a particular frequency or frequencies; and a pliable material (e.g., a woven fabric, plastic, other non-conductive pliable materials, etc.) having a pocket or pouch formed therein and in which the security element is positioned, and wherein the pliable material further comprises an extension having a free end, wherein the extension is manipulated to loop around the item and wherein the free end is fixedly secured (e.g., sewn, hot crimped, etc.) within the pouch or pocket of said pliable material.

A security tag wherein the extension forms a perpendicular relationship to the substrate.

A security tag wherein the extension forms a non-perpendicular angle with the substrate.

A security tag wherein the extension is manipulated to form a trapezoidal loop around the item when said free end is secured to a portion of said substrate.

A security tag adapted for coupling to an item (e.g., elegant or soft goods) wherein the security tag comprises: at least one security element (e.g., an EAS or RFID security element or any combination thereof in any frequency range or ranges) that responds to a magnetic or electromagnetic field of a particular frequency or frequencies; and a pliable material (e.g., a woven fabric, plastic, other non-conductive pliable materials, etc.) having a pocket or pouch formed therein and in which the security element is positioned and wherein the pliable material comprises at least two extensions, each having a respective free end, wherein the extensions are manipulated to loop around the item and wherein the free ends are fixedly secured (e.g., sewn, hot crimped, etc.) together.

A security tag comprising a cover portion that overlays and sandwiches the security element between the cover portion and the substrate to which the security element is attached.

A security tag wherein the at least two extensions form perpendicular relationships with the substrate.

A security tag that comprises a closure seam for fixedly securing the free ends of the extensions together.

A method for attaching a security tag to an item (e.g., elegant or soft goods) wherein the method comprises: enclosing a security element (e.g., an EAS or RFID security element or any combination thereof in any frequency range or ranges) within a pliable material (e.g., a woven fabric, plastic, other non-conductive pliable materials, etc.) wherein dimensions of the pliable material exceed dimensions of the security element around its periphery; manipulating the pliable material around the item so that opposing sides of the pliable material pass over a portion of each other; and fixedly securing (e.g., sewn, hot crimped, etc.) the opposing sides of the pliable material together.

A method wherein the step of coupling a security element to a pliable material also comprises applying a covering layer of the pliable material over the security element.

A method wherein the pliable material is a woven fabric.

A method wherein the pliable material is plastic.

A method wherein the step of fixedly securing the opposing sides of the pliable material together comprises sewing them together.

A method wherein the step of fixedly securing the opposing sides together comprises using hot crimping.

A method wherein the step of fixedly securing the opposing sides together comprises using an adhesive.

A method wherein the step of fixedly securing the opposing sides together comprises using ultrasonics.

A method wherein the step of fixedly securing the opposing sides together comprises using rivets.

A method for attaching a security tag to an item (e.g., elegant or soft goods) wherein the method comprises: forming a pouch or pocket of a pliable material (e.g., a woven fabric, plastic, other non-conductive pliable materials, etc.); disposing a security element (e.g., an EAS or RFID security element or any combination thereof in any frequency range or ranges) within the pouch or pocket; forming an extension of the pliable material that includes a free end; manipulating the extension to loop around the item; and fixedly securing (e.g., sewn, hot crimped, etc.) the free end of the extension within the pouch or pocket.

A method wherein the step of fixedly securing the free end comprises sewing the extension to the substrate.

A method wherein the step of fixedly securing the free end comprises using hot crimping.

A method for attaching a security tag to an item (e.g., elegant or soft goods) wherein the method comprises: forming a pouch or pocket of a pliable material e.g., a woven fabric, plastic, other non-conductive pliable materials, etc.); disposing a security element (e.g., an EAS or RFID security element or any combination thereof in any frequency range or ranges) within the pouch or pocket; forming at least two extensions of the pliable material and wherein each extension comprises a free end; securing the pouch or pocket closed; manipulating the extensions to loop around the item; and fixedly securing (e.g., sewn, hot crimped, etc.) the free ends of the extensions together.

A method wherein the step of fixedly securing the free end comprises sewing the free ends of the extensions together.

The method wherein the step of fixedly securing the free ends together comprises using hot crimping.

BRIEF DESCRIPTION OF SEVERAL VIEWS OF THE DRAWINGS

The invention will be described in conjunction with the following drawings in which like reference numerals designate like elements and wherein:

FIG. 5 depicts a plan view of the back side of another version of the first embodiment of the present invention showing the security element concealed within a pliable material;

FIG. 6 depicts an isometric view of the first embodiment of FIG. 5 having folded upper and lower edges and formed into a loop around an item (not shown) with overlapping edges fixedly secured together;

FIGS. 12-14 depict variations on the extension/lanyard of the second embodiment and depict the pouch or pocket for receiving the free end of that extension/lanyard;

FIG. 18 depicts the second embodiment with the loop formed by the extension/lanyard around the item to be protected (not shown);

FIG. 19 is similar to the view in FIG. 18 but with the cover portion removed, exposing the security element for viewing clarity only;

FIG. 20 is similar to FIG. 19 but with the security element shown in partial view;

DETAILED DESCRIPTION OF THE INVENTION

Figure 1:
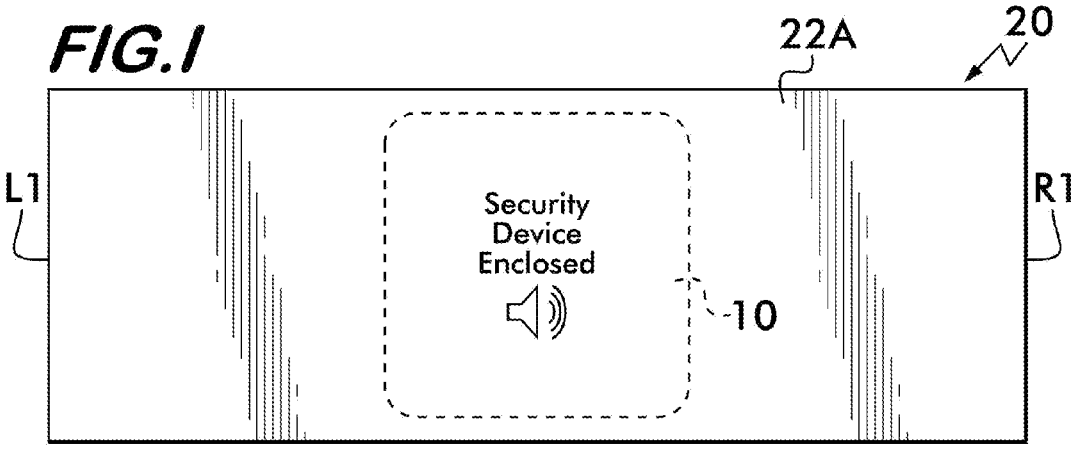
FIG. 1 is a plan view of the front side of a first embodiment of the present invention showing a security element concealed within a pliable material.

The present invention provides a product and method for coupling a radio frequency (RF), acousto-magnetic (AM), electromagnetic (EM) or other transmitting and/or receiving device, circuit, coil, microchip, antenna, EAS device, RFID device, or any combination thereof (hereinafter referred to as a "security element") to an item (or items) in a "zero or low impact" manner; the preferred items to which the present invention is attached are apparel or soft goods products, although this is by way of example only and not by way of limitation. The various embodiments of the product, as will be discussed in detail later, comprise a security element enclosed within a pliable material, hence forming a "security tag." It should be further noted that the frequency range of the operation of the security element presents no limitation to the present invention and that operation of a security element in the kHz range (or lower) or operation in the microwave or GHz range (or higher) is within the broadest scope of the present invention.

The principle of the present invention is to enclose a security element within a pliable material and to associate the formed security tag with the soft good. A first embodiment of the present invention (FIGS. 1-9) is constructed such that the dimensions of the pliable material exceed the dimensions of the security element. This permits the folding of upper and lower edges around the security element, while closing the transverse edges to enclose the security element therein. These transverse edges of the pliable material form opposing edges and one of which is then looped around the elegant item or soft good (not shown) and then opposing edges of the pliable material are secured (e.g., by sewing, or adhesive, hot melting, crimping, ultrasonics, riveting or other known methods of attachment) to each other to close the loop. A second embodiment (FIGS. 10A-29) uses an extension or lanyard of the pliable material which is then looped around the elegant item or soft good and then portions of the extension or lanyard are then secured (e.g., by sewing, adhesive, hot melting, crimping, ultrasonics, riveting or other known method of attachment) within a pouch or pocket to close the loop. The second embodiment also includes the use of a pair of extensions or lanyards (FIGS. 30-35) which are then looped around the elegant item or soft good and then the free ends of the extension or lanyard are then secured (e.g., by sewing, adhesive, hot melting, crimping, ultrasonics, riveting or other known method of attachment) together to close the loop.

It should be understood that the pliable material may comprise a wide range of materials that can be rolled or looped such as, but not limited to, fabric (e.g., woven materials, etc.) or plastic, etc.

In all of the embodiments discussed below, the security element may be attached to the pliable material. This may be accomplished in a variety of ways but the most preferred method is an adhesive, typically, using hot melt rubber-based adhesives. These adhesives are used for the application of the security element to the pliable material. Alternatively, the security element may simply be free-floating within the pliable material.

It should be further understood that where the term "sewn" is used throughout the Specification, it is to be construed in its broadest interpretation to include all manners and kinds of sewing. Reference number 132 (FIGS. 18-20) indicates an example of a securement by sewing. The preferred method of accomplishing the securement is via sewing, although all other well known types of securement (e.g., hot crimping, adhesive, ultrasonics, riveting, etc.) are within the broadest scope of the invention.

First Embodiment

Figure 2:
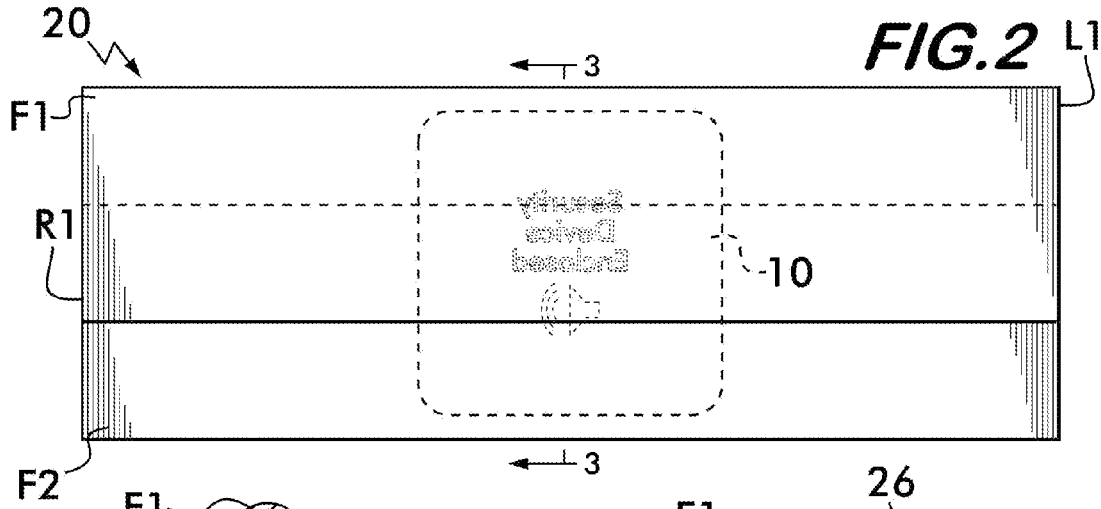
FIG. 2 is a plan view of the back side of the first embodiment of the present invention.
Figure 3:
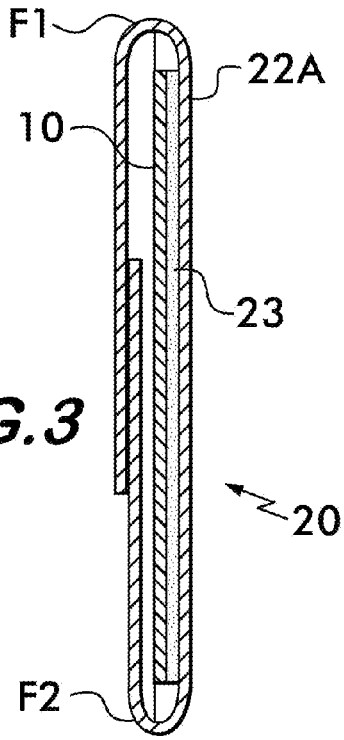
FIG. 3 is a cross-sectional view of the present invention taken along line 3-3 of FIG. 2.
Figure 10A:
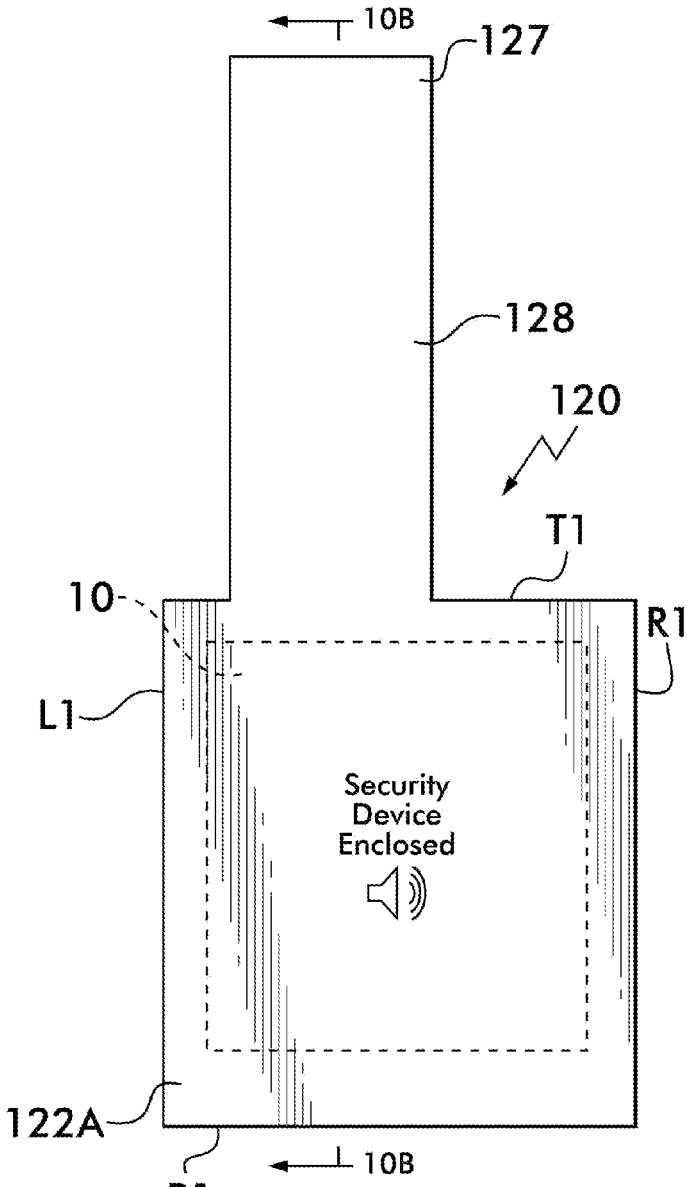
FIG. 10A is a plan view of the second embodiment of the present invention which includes an extension or lanyard of pliable material for looping around an item to be protected.

As can be seen in FIGS. 1-2, the invention 20 comprises a pliable material (e.g., a woven fabric, a plastic material, etc.) 22A in which a security element 10 (e.g., an EAS security element, RFID security element, a combination of security elements or tags, etc.) is concealed, e.g., via an adhesive 23, or ultrasonic bonding, or simply free-floating (see FIG. 10A). This material comprises a non-conductive material. In particular, with the security element 10 positioned against the pliable material 22A (and either adhesively secured or free-floating), an upper portion of the pliable material 22A and a lower portion of the pliable material 22A are folded around the security element 10 to form respective folds F1 and F2 that overlap (see FIG. 3). These folds are heated and pressed which applies a memory to the pliable material 22 at the folds F1 and F2 such that they do not come apart, thereby concealing the security element 10 therein; alternatively, an adhesive can be applied at the overlap of folds F1 and F2. In addition, the sides of the pliable material 22A are bonded to form closed left L1 and right edges R1, thereby enclosing the security element 10 within the pliable material 22A.

Figure 4:
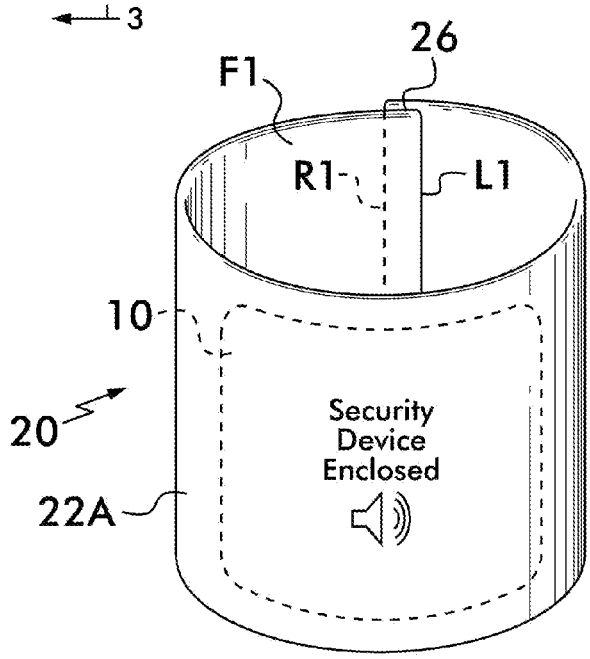
FIG. 4 is an isometric view of the first embodiment formed into a loop around an item (not shown) with overlapping edges fixedly secured together.

Either edge L1 or R1 is then looped around the item (not shown, e.g., a soft good or the suspension article (e.g., a hangar strut, etc.) of the soft good, or around a portion of the item (e.g., an opening, a tie, lace, etc.)) such that edges L1 and R1 form opposing ends that overlap and which are then fixedly secured together, e.g., by being sewn together; alternatively a crimping tool can be used for utilizing a hot crimping process to form a permanent attachment interface 26 (see FIG. 4).

By way of example only, the front side of the pliable material 22 comprises indicia of various kinds, such as item-related indicia (e.g., price, size, etc.) and/or visual theft deterrent indicia (e.g., "security device enclosed") but not limited to only those types. For example, where RFID integrated circuits (ICs) are used as the security element 10, the indicia may include notification to the customer that an RFID IC is included therein, in case the customer wishes to remove the IC after purchase due to privacy concerns.

Another variation of the first embodiment is shown in FIG. 5 where the invention 20A comprises a pliable material (e.g., a woven fabric, a plastic material, etc.) 22 in which a security element 10 (e.g., an EAS security element, RFID security element, a combination of security elements or tags, etc.) is concealed, e.g., via an adhesive 23, or ultrasonic bonding, or simply free-floating (see FIG. 10A). This material comprises a non-conductive material. A cover layer 22A of the same pliable material is placed over the security element 10 and secured to the pliable material 22. Although there are many methods of securing the cover layer 22A and the pliable material 22 together while preventing access by a would-be thief to the security element 10, the preferred method (as discussed previously with regard to FIGS. 1-4) is via the use of folds F1 and F2 along an upper edge and a lower edge, as shown in FIGS. 1-2, which can be set by ultrasonically bonding, or melting the folds or via an adhesive.

By way of example only, this cover layer 22A contains indicia of various kinds, such as item-related indicia (e.g., price, size, etc.,) and/or visual theft deterrent indicia (e.g., "security device enclosed") but not limited to only those types. For example, where RFID ICs are used as the security element 10, the indicia may include notification to the customer that an RFID IC is included therein, in case the customer wishes to remove the IC after purchase due to privacy concerns.

Figure 6A:
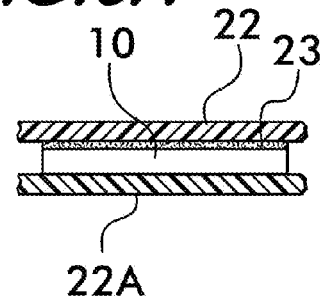
FIG. 6A is a cross-sectional view of the first embodiment of FIG. 5 taken along line 6A-6A of FIG. 6.

FIG. 6A is a partial cross-sectional view of the invention 20 showing how the pliable material 22 and the cover portion 22A form a front and back side of the invention 20. It should be understood that the cover portion 22A may comprise a separate element that is secured (e.g., by being sewn or by hot crimping, etc.) to the pliable material 22 around the edges of the security element 10.

With the pliable material 22 and the cover portion 22A secured together, the dimensions of these front/back sides of the invention 20 are greater than the security element 10 dimensions. As a result, the invention 20 can be rolled or looped around an item to be protected (not shown) so that opposing edges, either horizontally or vertically, can be passed over each other and then secured, e.g., by being sewn together; alternatively a crimping tool can be used for utilizing a hot crimping process to form a permanent attachment interface 26 (see FIG. 2).

Figure 7:
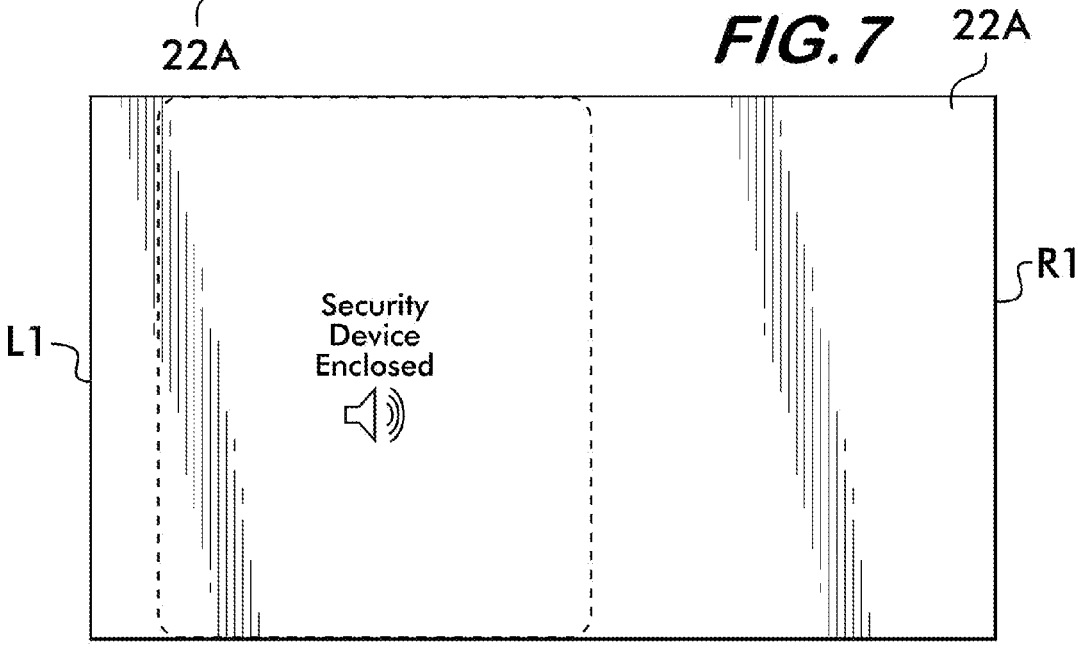
FIG. 7 is also a plan view of a further version of the first embodiment showing the front side of the pliable material which contains labeling information.
Figure 8:
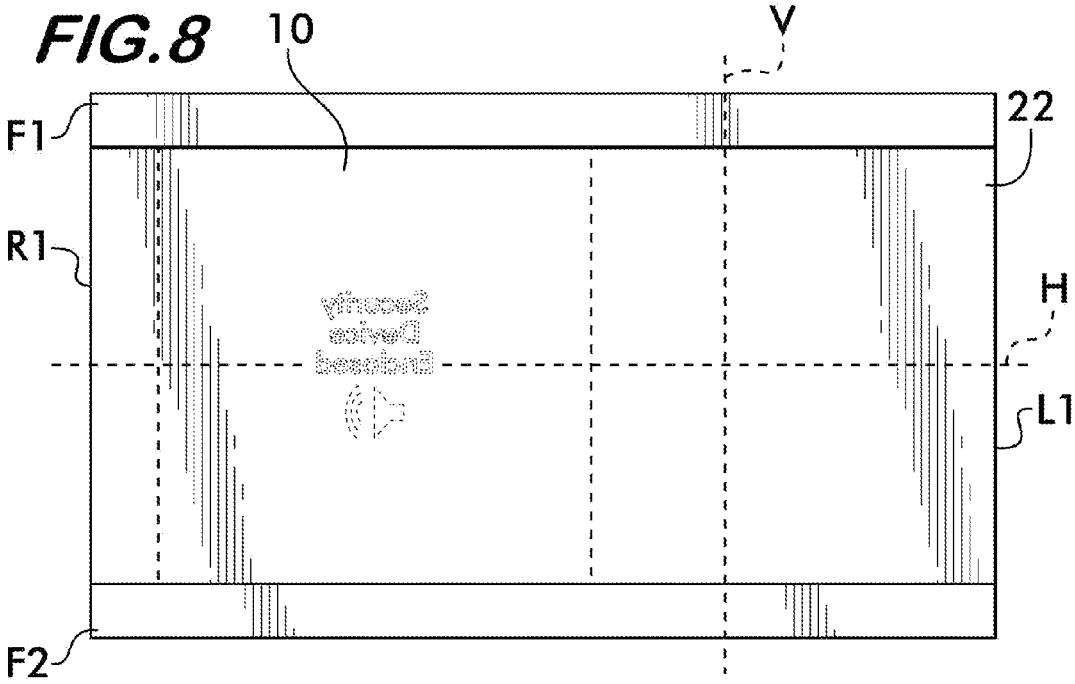
FIG. 8 is plan view of the back side of the embodiment of FIG. 7, showing the security element attached to the pliable material.
Figure 9:
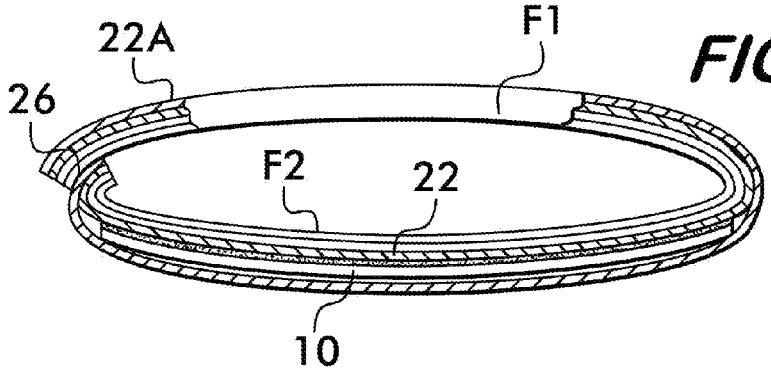
FIG. 9 is a top view of the embodiment of FIG. 8 formed into a loop around an item (not shown) with overlapping opposing edges secured together.

FIGS. 7-9 provide another variation of the first embodiment 20. In FIG. 8 (showing the back side of the first embodiment 20), it can be seen that the vertical dimension of the security element 10 is similar to the vertical dimension of the pliable material 22. Thus, in this case, the pliable material 22A can be rolled about a vertical axis V but not about a horizontal axis, H. FIG. 7 is a plan view of the first embodiment 20 of the front side 22A whereas FIG. 8 shows the back side of the first embodiment 20. FIG. 9 is a top view of the first embodiment 20 showing the overlap of the edges of the pliable material/cover portion 22A and the permanent attachment interface 26. As discussed previously, it should be understood that before the permanent attachment interface 26 is formed (e.g., by being sewn, or via an adhesive, hot melting, crimping, ultrasonics, riveting or other known methods of attachment) either one of the closed opposing edges L1 or R1 is looped around the item (not shown) to be protected, and then overlapped with the other opposing edge and the attachment interface 26 is formed.

Second Embodiment

As mentioned previously, the second embodiment 120 uses an extension or lanyard 128 that is looped around the item to be protected, rather than the closed opposing ends L1 and R1.

Figure 10B:
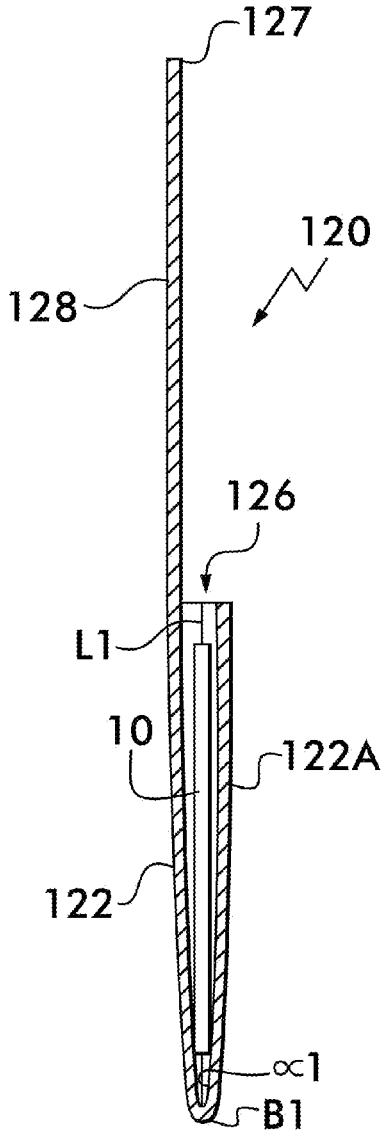
FIG. 10B is a side view of the second embodiment, taken along line 10B-10B of FIG. 10A, showing the security element embedded between pliable material layers.

In particular, FIG. 10A shows a side view of the second embodiment 120 whereby the pliable material 122 is folded B1 to form a cover portion 122A that sandwiches the security element 10 but wherein the pliable material 122 includes an integral extension or lanyard 128. The sides L1 and R1 (FIG. 10A) of the pliable material 122 are closed to form an opening 126 to receive the free end 127 of the extension/lanyard 128 once it is looped around the item to be protected. What is formed is a type of "pouch" or "pocket" or "package" which receives the free end 127 of the extension or lanyard 128. The opening 126 is then secured closed using a variety of methods, with the preferred method being the use of hot crimping. FIG. 10B shows a plan view of this second embodiment 120.

It should be understood that the second embodiment, as well as the other variations thereof discussed below, may be formed in a variety of ways. The preferred method is where side edges L1 and L2 (FIG. 10B) are formed either by bonding or melting the side edges of the pliable material 122 and the cover portion 122A together. The bottom edge B1 is a folded side where the pliable material 122 and the cover portion 122A form an acute angle $\alpha 1$ (FIG. 10A). The result is a structure that comprises three closed sides (L1, R1 and B1) and an open side T1, which forms the opening 126. It should also be understood that it is possible to heat crimp closed, sew, or adhesively close edge T1 at, or at some point below edge T1, (e.g., see reference 132 in FIGS. 18-20) once the free end of the extension/lanyard 128 is disposed in the pouch or pocket. With regard to edges L1 and R1, it should be understood that those edges can be formed by heat melting or ultrasonic cutting and bonding of the side edges of the pliable material 122 and the cover portion 122A.

Alternatively, L1 and R1 can be formed by adhesively sealing the side edges of the pliable material 122 and the cover portion 122A.

Another variation is where edge B1 is not a fold but is rather also adhesively sealed. In that circumstance, pliable material 122 and the cover portion 122A comprise distinct layers having respective bottom edges that, when adhesively sealed together, form the bottom edge B1.

A further variation is to form the pouch or pocket within the pliable material 122 itself, thereby forming a "woven cavity". In particular, using a process known as "tube weaving", the edges L1, R1, B1 are woven edges with an open edge T1 which form an integral pouch or pocket for permitting depositing the security element 10 therein and for receiving the free end of the extension/lanyard 128. As with all of the other embodiments, the open edge T1 is then closed using a heat crimp, sewing or adhesive.

Figure 11A:
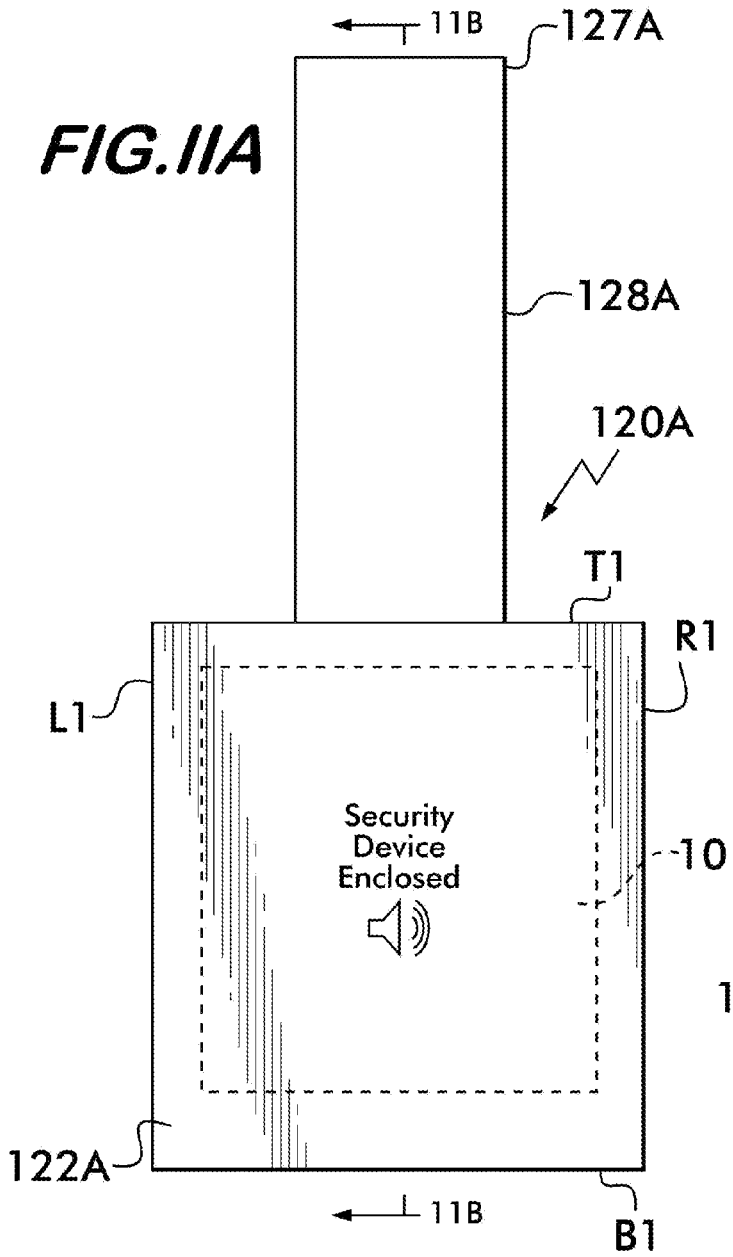
FIG. 11A is a plan view of the alternative version of the second embodiment of the present invention wherein the lanyard is a separate element from the pliable material layers.
Figure 11B:
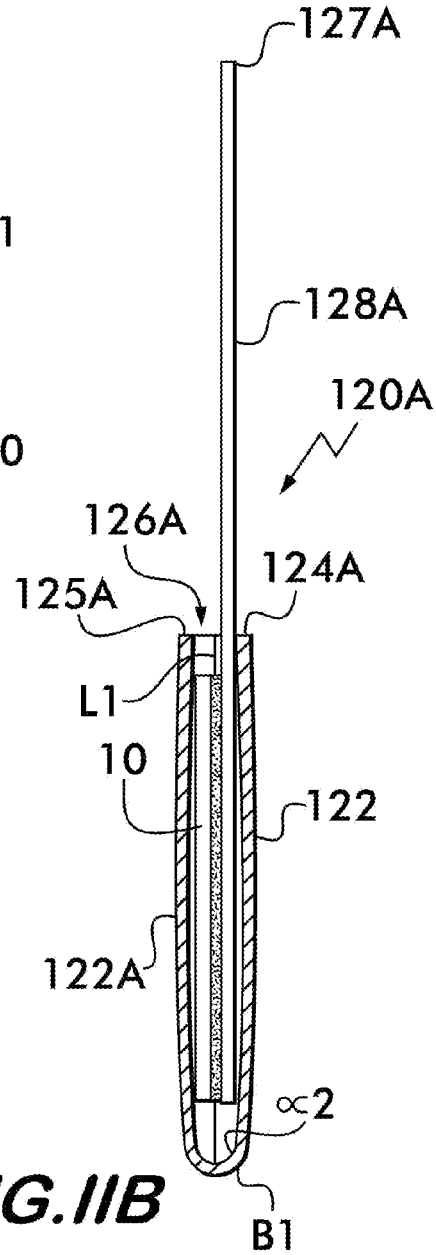
FIG. 11B is a side view of the alternative version of the second embodiment, taken along line 11B-11B of FIG. 11A, showing the pliable material layers sandwiching the security element.

FIG. 11A shows a side view of an alternative second embodiment 120A wherein the extension or lanyard 128A is not integrated with the pliable material 122 but is a separate element (also made of a pliable material) that is secured to the pliable material 122 (or cover portion 122A) during the sandwiching process of the security element 10. The securement of the extension/lanyard 128A can be accomplished using a variety of processes, although the preferred method is to sew the extension/lanyard 128A to the pliable material 122 (or cover portion 122A) as previously discussed with regard to FIGS. 10A-10B; alternatively, via using a hot crimping process which would simultaneously apply the lanyard 128A to the pliable material 122 (or cover portion 122A) when the opening 126A is formed, as discussed previously with regard to FIGS. 10A-10B. Thus, the upper portions 124A and 125A of the cover portion 122A and the pliable material 122 are secured together (e.g., by being sewn or by hot crimping), while securing the lanyard 128A thereto also, and an opening 126A is formed to receive the free end 127A of the lanyard 128A therein. As mentioned previously, what is formed is a type of "pouch" or "pocket" which receives the free end 127A of the lanyard 128A. Once the free end 127A is looped around the item to be protected, it is inserted through the opening 126A of the pocket or pouch and then this opening is secured shut, e.g., by being sewn or by using the hot crimp process. FIG. 11B shows a plan view of this second embodiment 120A. As with the embodiment of FIGS. 10A-10B, the bottom edge B1 is a folded side where the pliable material 122 and the cover portion 122A form an acute angle $\alpha$2 (FIG. 11A).

FIGS. 12-14 depict variations on the extension/lanyard 128 (or 128A) of the second embodiment whose free end 127 is looped around the item to be protected and then positioned through the opening 126. The various designs of the free end 127 adds more surface area to the lanyard that is trapped when the opening 126 is sealed. FIG. 12 includes a semicircular tip at the free end 127, whereas FIG. 13 includes an angled lanyard 128 with a pointed free end 127; FIG. 14 depicts a shortened lanyard 128.

Figure 15:
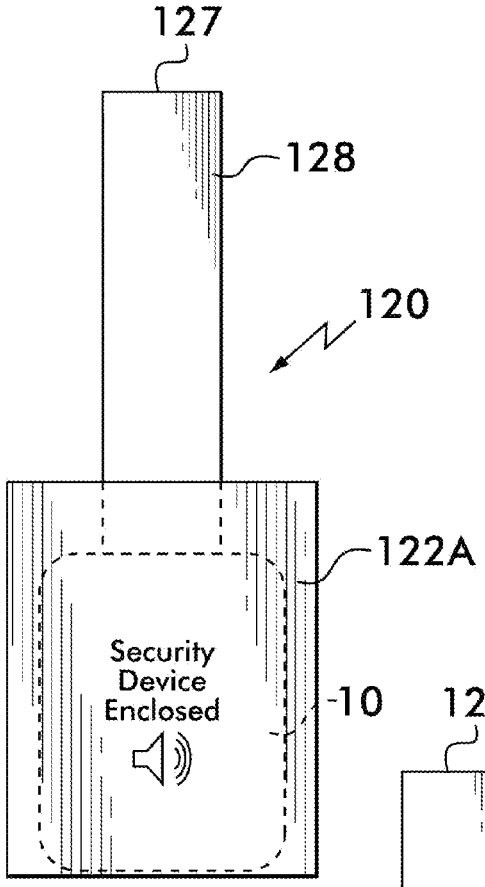
FIG. 15 depicts a plan view of the second embodiment of the present invention showing the extension/lanyard that is looped around the item to be protected.
Figure 16:
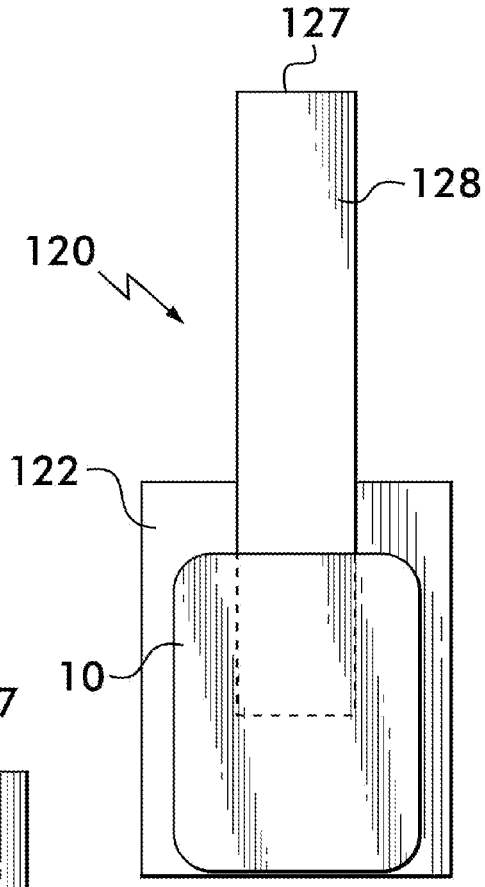
FIG. 16 is the same view as FIG. 15 except that the cover portion of the pouch or pocket has been omitted, revealing the security element.
Figure 17:
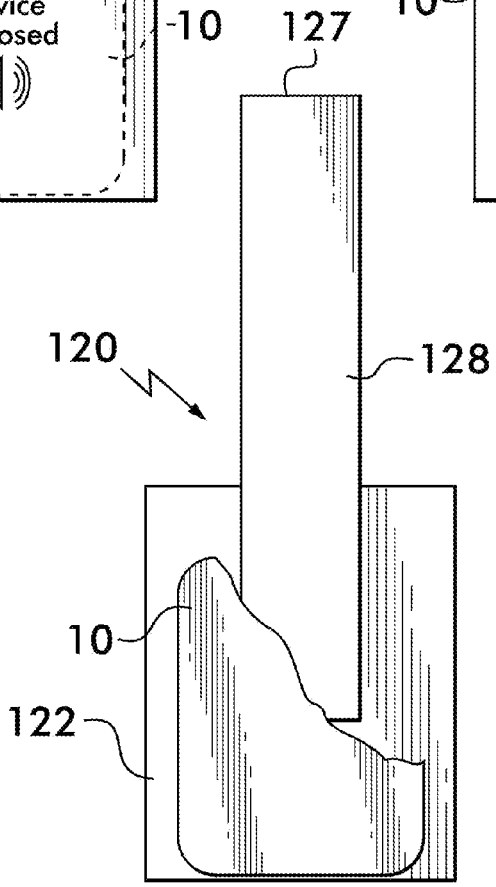
FIG. 17 is a similar view to that of FIG. 16 but showing the security element in partial view.

FIGS. 15-17 show enlarged views of the second embodiment 120 with and without the cover portion 122A, exposing the security element 10 for viewing clarity only.

FIG. 18 depicts the second embodiment 120 with the loop 130 formed (by the extension/lanyard 128) around the item to be protected (not shown) and also shows the closure seam 132 (e.g., by being sewn, adhesive, hot melting, crimping, ultrasonics, riveting or other known methods of attachment). FIG. 19 is similar to the view in FIG. 18 but with the cover portion 122A removed, exposing the security element 10 for viewing clarity only. FIG. 20 is similar to FIG. 19 but with the security element 10 shown in partial view.

Figure 21:
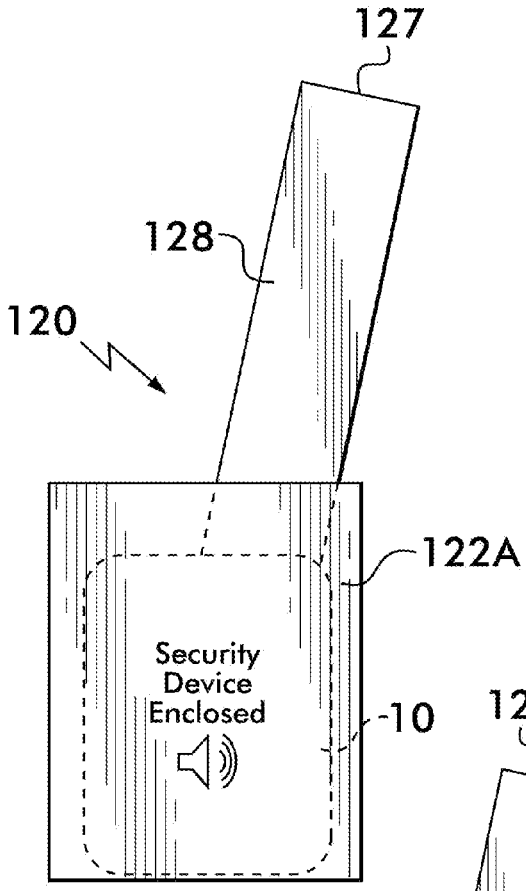
FIG. 21 depicts the second embodiment using an angled extension/lanyard to achieve a different presentation on the soft goods to which it is attached.
Figure 22:
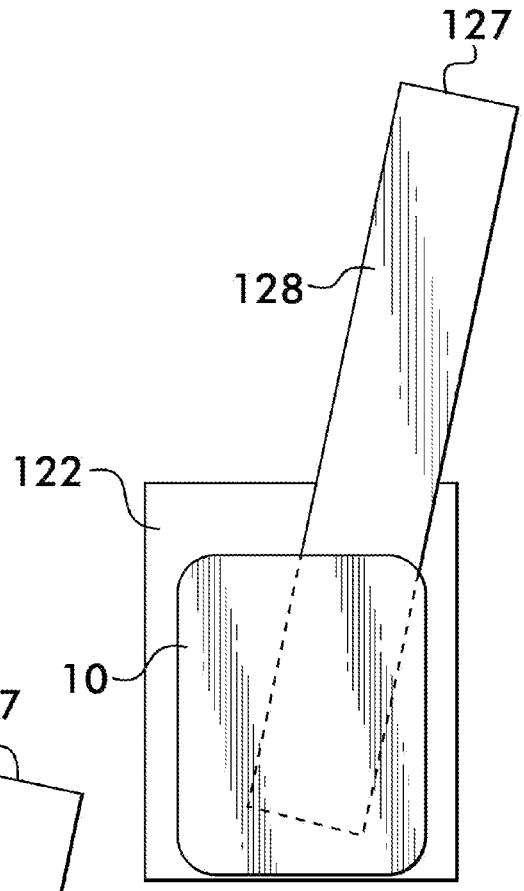
FIG. 22 is a similar view to that of FIG. 21 but with the cover portion omitted.
Figure 23:
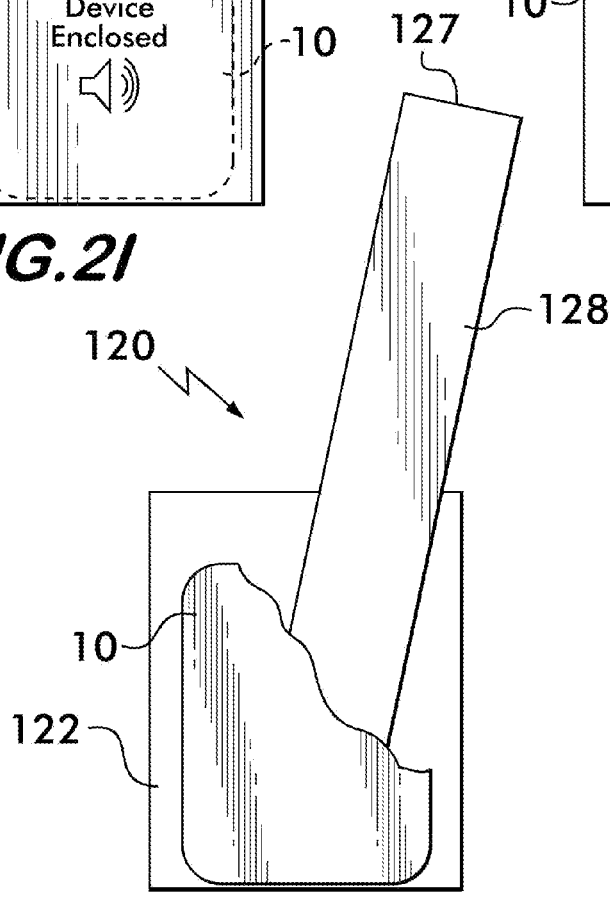
FIG. 23 is a similar view to that of FIG. 22 but with the security element shown in partial view.
Figure 24:
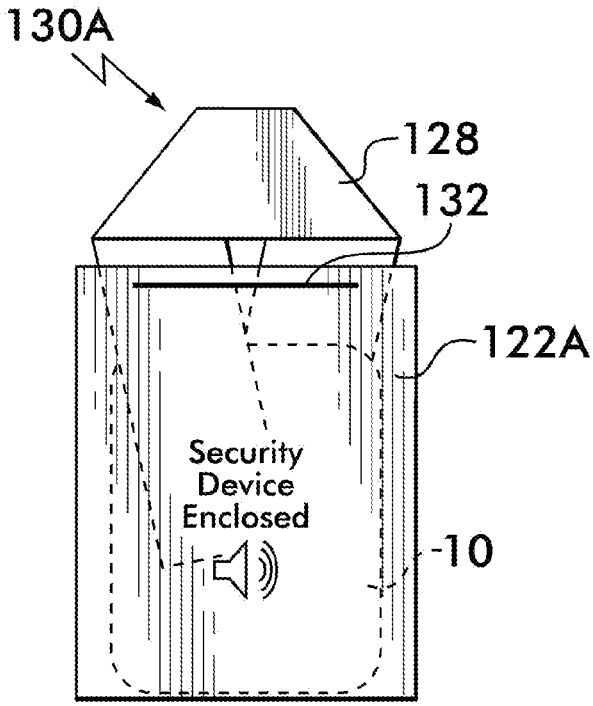
FIGS. 24-26 depict an angled extension/lanyard that is manipulated to form a trapezoidal loop with the crossover facing the labeling side and with the cover portion removed in FIGS. 25-26.
Figure 25:
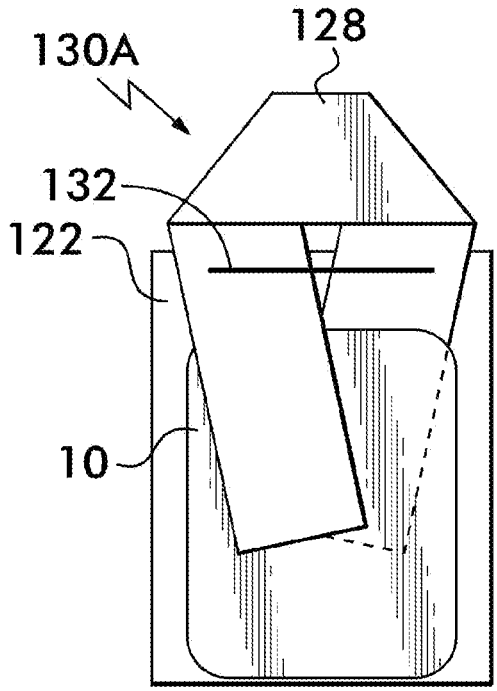
Figure 26:
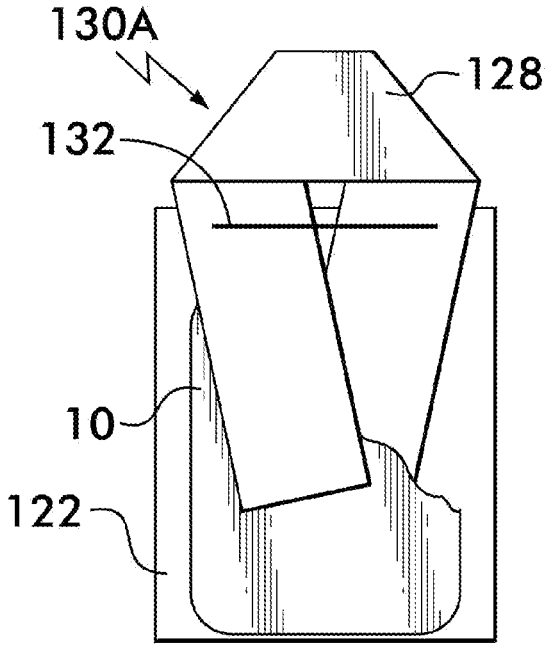
Figure 27:
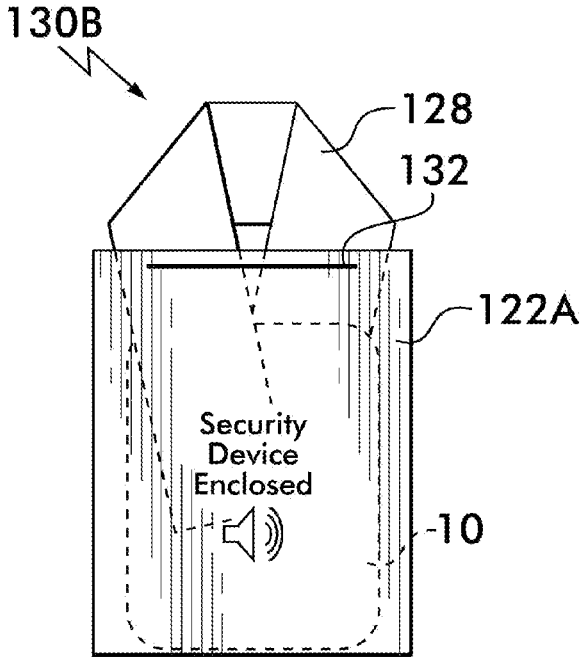
FIGS. 27-29 depict the angled extension/lanyard that is manipulated to form the trapezoidal loop with the crossover on the back side of the invention and with the cover portion removed in FIGS. 28-29.
Figure 28:
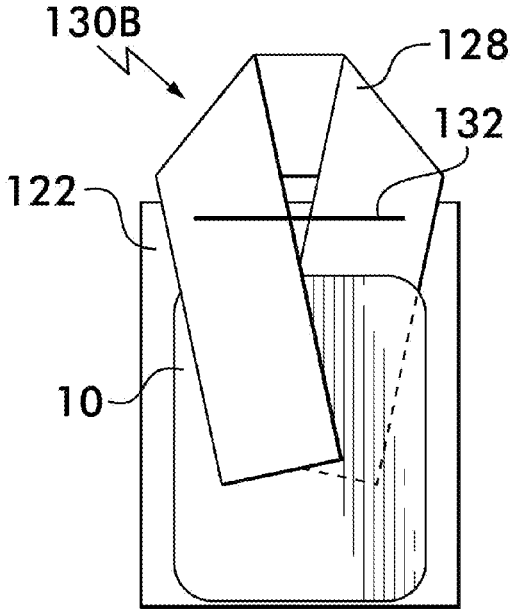
Figure 29:
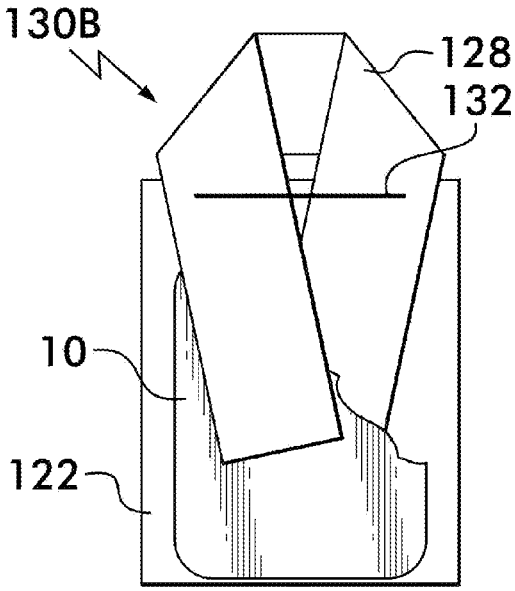

To provide different presentations of the invention when attached to the elegant or soft goods, the extension/lanyard 128 may be angled with respect to the pouch or pocket when it is secured to the pliable material 122/cover portion 122A. For example, FIG. 21 is a plan view of the second embodiment 120 showing the extension/lanyard 128 oriented at an angle. FIG. 22 is a similar view as in FIG. 21 but with the cover portion 122A omitted and FIG. 22 is identical to FIG. 21 but with the security element 10 shown in partial view. The advantage of orienting the extension/lanyard 128 at an angle can be seen more clearly by the way the free end 127 is inserted into the pocket or pouch, as shown in FIGS. 24-26 and FIGS. 27-29. In FIGS. 24-26, the loop 130A formed by the angled extension/lanyard 128 is a trapezoidal-shaped loop that appears on the labeling side of the invention 120; FIGS. 25-26 reflect this. When this loop 130A is formed, the free end 127 of the extension/lanyard 128 is folded upward, out of the plane of the paper, folded to the left and then downward through the opening 126. In contrast, in FIGS. 27-29, the loop 130B formed by the angled extension/lanyard 128 is also a trapezoidal-shaped loop but that loop is formed on the opposite side, away from the labeling side of the invention 120; FIGS. 28-29 reflect this. When this loop 130B is formed, the free end 127 of the extension/lanyard 128 is folded downward, into the plane of the paper, folded to the left and then downward through the opening 126.

Figure 30:
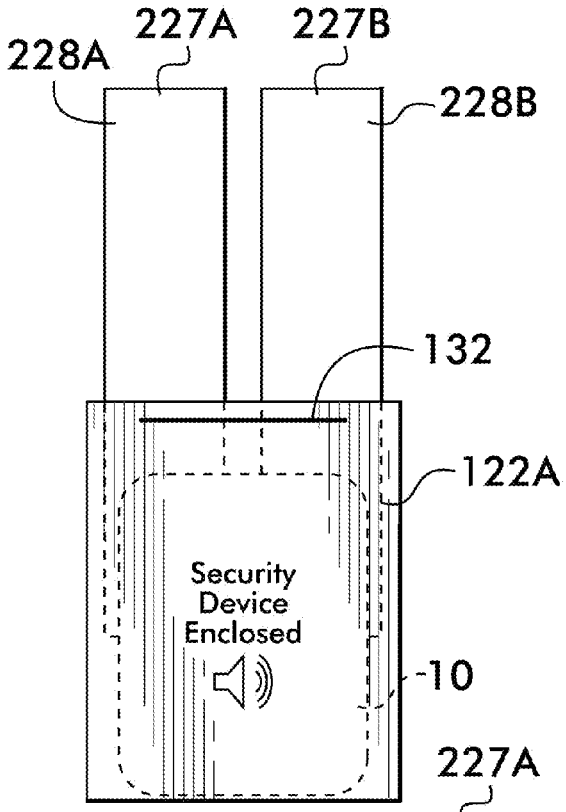
FIGS. 30-32 depict another variation of the second embodiment wherein two extension/lanyards are used with the cover portion removed in FIGS. 31-32.
Figure 31:
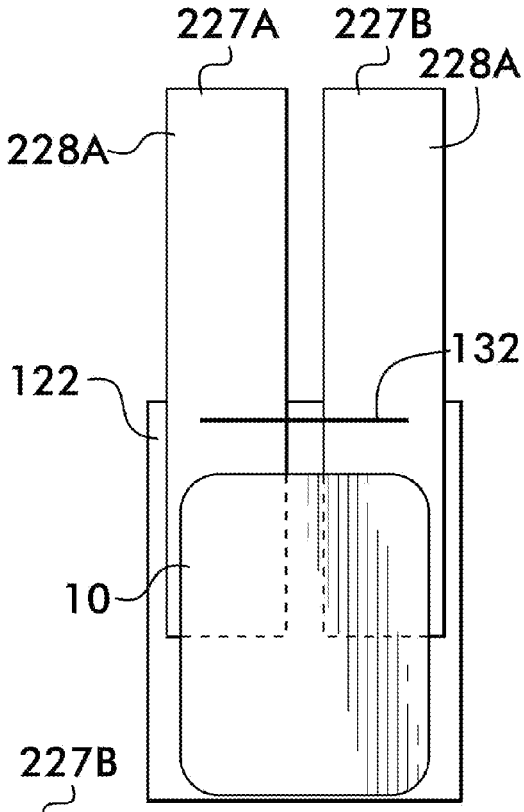
Figure 32:
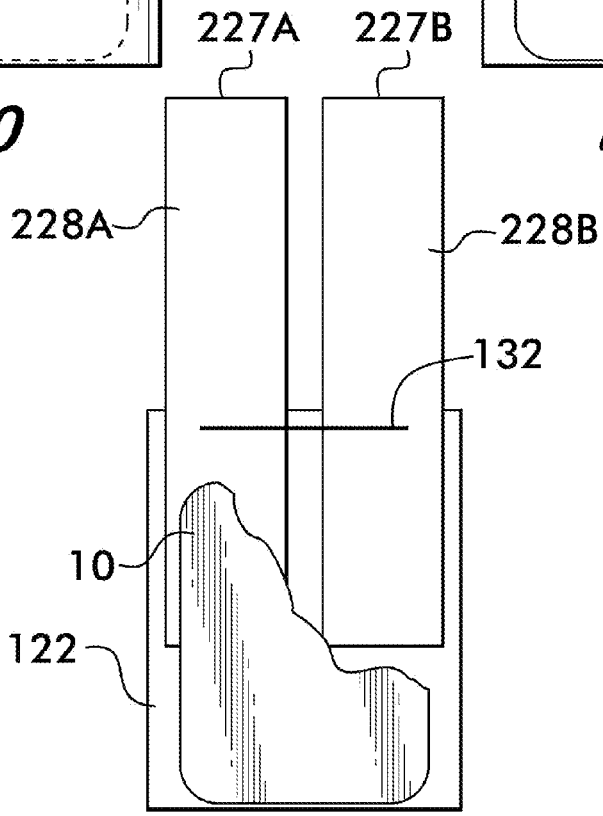
Figure 33:
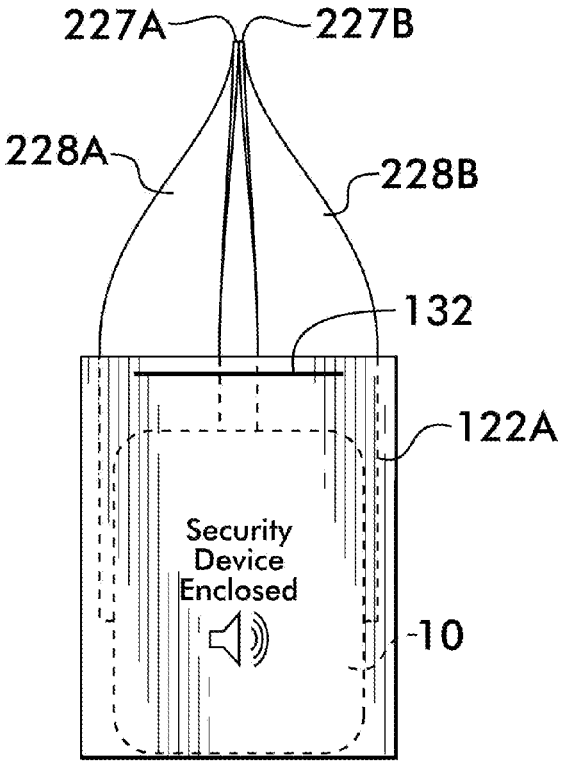
FIGS. 33-35 depict how the dual extension/lanyards are used to form the loop around the item to be protected and with the cover portion removed in FIGS. 34-35.
Figure 34:
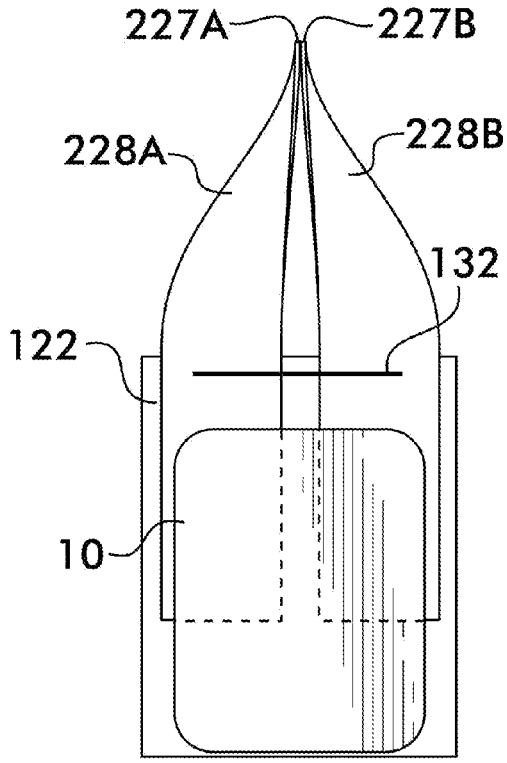
Figure 35:
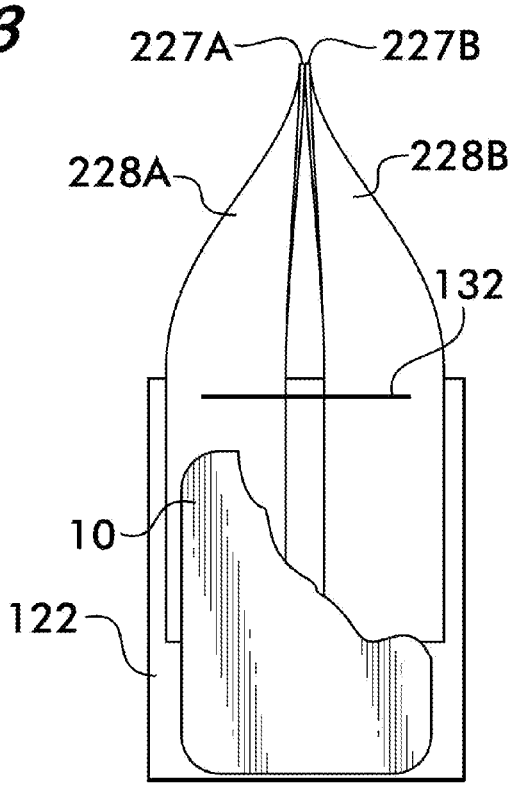

FIGS. 30-35 depict another variation of the second embodiment whereby dual extension/lanyards are used, which may be integral extension/lanyards of the pliable material 122 or separate from the pliable material 122. In this version, the loop 230 is not formed by single extension/lanyard whose free end is captured within the pocket or pouch but rather it is the joining of the free ends of the two extension/lanyards that forms the loop around the item to be protected. In particular, extension/lanyards 228A and 228B are secured at their respective ends within the pouch or pocket (where discrete extensions, as opposed to integral extensions, are used) and then the closure seam 132 is formed. FIGS. 30-32 depict this. The free ends 227A and 227B of the extension/lanyards are positioned around an item to be protected (not shown) and then these free ends are secured together, e.g., by being sewn together or by using a hot crimp process, etc. FIG. 33 depicts a plan view of this variation of the second embodiment; FIGS. 34-35 depict the same invention but with the cover portion 122A removed.

It should be understood that where integral extensions are used, the closure seam 132 is still required to conceal the security element 10 and thereby deny access for tampering by a would-be thief.

It should be understood that in the hot crimping process involves the use of a crimp tool that utilizes heat to create localized heat (rather than ambient heat) to avoid damaging the security element 10. The hot crimp process melts the pliable material, free end of the extension/lanyard and the cover portion together to secure the loop of the invention around the item to be protected; a heat-activated adhesive or acrylic adhesive is used therewith. The width of this hot crimp seam may comprise 1/16" or 1/32" by way of example only.

It should also be understood that in some cases the soft good may include an unfinished component or loop itself and over which the present invention 20/120 is then looped and then the unfinished portion of the soft good is then secured to the soft good itself. For example, if the unfinished component were a belt loop, the loop 130 or 230 may be secured thereto and then the belt loop is stitched or secured to the pants waist portion.

As mentioned previously, the invention in either the first or second embodiments can include several different variations; where the extending arm is twisted or manipulated in order to hang in a desired fashion from the item; where the extending arm is shaped to have a desired look or influence in order to hang in a desired fashion from the item; wherein the extending arm or the package itself is of a certain length as to fasten several items together. Different embodiments and/or variations may comprise different colors or material constructions to have the desired appearance or may carry desired information such as but not limited to instructions to remove the item due to the nature of the device, e.g., "RFID device enclosed, remove if desired", or "RFID device enclosed—if this labeling is removed the item can not be returned." Other instructions are also intended for this packaging.

The invention may also be constructed with additional material to enhance the bonding characteristics when the package is fastened to itself either to enhance the crimping or hot melt properties or to strengthen the package to reduce the ease in which the invention can be removed from the item to which it is attached. The same characteristics are intended to be used in the body of the invention and or the extension/lanyard that loops around the item or items.

As also mentioned previously, any of the extensions or lanyards can be part of the same fabric material used in the main body of the package or be a separate piece of fabric, it may also be a material different then the main body of the package. The extension or lanyard of material can be attached to the main body of the package by being sewn to the main body or by adhesive, by ultrasonic bonding, by using the characteristics of the device such as adhesive on the device, by crimping, riveting or other known means of attachment.

The present invention provides a means to attach a non-invasive package which holds a device to an item or items so that it may be attached in an efficient manner, not be a permanent fixture of the item or items, carry instructions or brand information, attached at the source of manufacture, attached at distribution, attached at retail or at any location along the supply chain. The present invention is intended to be removed from the item by the consumer.

It should be further noted that where any of the foregoing inventions are provided to a customer before they are looped or otherwise associated with the soft goods, the free end of the extension(s)/lanyard(s) can be temporarily positioned within the pouch or pocket during shipping. This protects the extension(s)/lanyard(s) during shipping. Thus, by way of example only, the free end and the majority of the extension/lanyard 128 (FIG. 8) would be positioned within the opening 126 during shipping. Upon arrival, the free end of the extension/lanyard 128 would be removed from the opening 126 and then looped around the item to be protected and then secured (e.g., by being sewn, or hot crimping process, etc.) as discussed previously.

While the invention has been described in detail and with reference to specific examples thereof, it will be apparent to one skilled in the art that various changes and modifications can be made therein without departing from the spirit and scope thereof.

What is claimed is:

1. A security tag adapted for coupling to an item, said security tag comprising:

at least one security element that responds to a magnetic or electromagnetic field of a particular frequency or frequencies; and a pliable material in which said security element is positioned and wherein said pliable material comprises dimensions that are greater than dimensions of said security element, said pliable material having upper and lower edges that are folded, said pliable material having closed opposing ends, transverse to said upper and lower edges, that can be looped around the item and over each other, said opposing ends being fixedly secured to each other.

2. The security tag of claim 1 further comprising a closure seam for fixedly securing said opposing ends to each other.

3. A security tag adapted for coupling to an item, said security tag comprising:

at least one security element that responds to a magnetic or electromagnetic field of a particular frequency or frequencies; and a pliable material having a pocket or pouch formed therein and in which said security element is positioned, said pliable material further comprising an extension having a free end, said extension being manipulated to loop around the item and wherein said free end is fixedly secured within said pocket or pouch of said pliable material.

4. The security tag of claim 3 further comprising a closure seam for fixedly securing the looped free end of said extension within said pocket or pouch.

5. The security tag of claim 3 wherein said extension comprises an integral portion of said pliable material.

6. The security tag of claim 3 wherein said pouch or pocket is formed by a folded pliable material whose sides are closed.

7. The security tag of claim 3 wherein said pouch or pocket is formed by a cover portion that overlays and sandwiches said security element between said cover portion and said pliable material, said cover portion being secured to said pliable material along three sides.

8. The security tag of claim 3 wherein said extension is a discrete element having a first end positioned within said pouch or pocket.

9. A security tag adapted for coupling to an item, said security tag comprising:

at least one security element that responds to a magnetic or electromagnetic field of a particular frequency or frequencies; and a pliable material having a pocket or pouch formed therein and in which said security element is positioned, said pliable material further comprising at least two extensions each having respective free ends, said extensions being manipulated to loop around the item and wherein said free ends are fixedly secured together.

10. The security tag of claim 9 further comprising a closure seam for fixedly securing said pocket or pouch closed.

11. The security tag of claim 10 wherein said at least two extensions comprise integral portions of said substrate.

12. A method for attaching a security tag to an item, said method comprising:

enclosing a security element within a pliable material wherein dimensions of said pliable material exceed dimensions of said security element around its periphery;

manipulating said pliable material around the item so that opposing sides of said pliable material pass over a portion of each other; and fixedly securing said opposing sides of said pliable material together.

13. A method for attaching a security tag to an item, said method comprising:

forming a pouch or pocket of a pliable material;

disposing a security element within said pouch or pocket;

forming an extension of said pliable material that includes a free end;

manipulating said extension to loop around the item; and fixedly securing said free end of said extension within said pouch or pocket.

14. The method of claim 13 wherein said step of forming an extension of said pliable material comprises securing a first end of said extension within said pocket or pouch.

15. The method of claim 13 wherein said step of manipulating said extension comprises folding or twisting said extension before fixedly securing said free end of said extension to said substrate.

16. A method for attaching a security tag to an item, said method comprising:

forming a pouch or pocket of a pliable material;

disposing a security element within said pouch or pocket;

forming at least two extensions of said pliable material and wherein each extension comprises a free end;

securing pouch or pocket closed;

manipulating said extensions to loop around the item;

fixedly securing said free ends of said extensions together.

17. The method of claim 16 wherein said step of forming at least two extensions comprises using discrete extensions having first ends that are disposed within said pouch or pocket.

* * * * *